US009388784B2

(12) United States Patent
Lindner et al.

(10) Patent No.: US 9,388,784 B2
(45) Date of Patent: Jul. 12, 2016

(54) INTERNAL COMBUSTION ENGINE WITH INJECTION VALVE

(75) Inventors: Marko Lindner, Ingolstadt (DE); Karsten Krippner, Ingolstadt (DE)

(73) Assignee: AUDI AG, Ingolstadt (DE)

( * ) Notice: Subject to any disclaimer, the term of this patent is extended or adjusted under 35 U.S.C. 154(b) by 434 days.

(21) Appl. No.: 13/816,876

(22) PCT Filed: Aug. 11, 2011

(86) PCT No.: PCT/EP2011/004035

§ 371 (c)(1),
(2), (4) Date: Feb. 13, 2013

(87) PCT Pub. No.: WO2012/022447

PCT Pub. Date: Feb. 23, 2012

(65) Prior Publication Data

US 2013/0146030 A1 Jun. 13, 2013

(30) Foreign Application Priority Data

Aug. 14, 2010 (DE) ..... 10 2010 034 411

(51) Int. Cl.
*F02M 1/00* (2006.01)
*F02M 69/04* (2006.01)
*F02M 61/14* (2006.01)

(52) U.S. Cl.
CPC ..... *F02M 69/04* (2013.01); *F02M 61/14* (2013.01); *F02M 2200/852* (2013.01); *F02M 2200/853* (2013.01)

(58) Field of Classification Search
CPC ..... F02M 61/14; F02M 61/168
USPC ..... 123/468, 469, 470, 456
See application file for complete search history.

(56) References Cited

U.S. PATENT DOCUMENTS 4,307,693 A 12/1981 Glöckler et al.
5,520,151 A * 5/1996 Gras et al. ..... 123/470

(Continued)

FOREIGN PATENT DOCUMENTS

| | | |
|---|---|---|
| CN | 101235779 | 8/2008 |
| CN | 101542105 | 9/2009 |
| DE | 100 12 759 | 9/2001 |
| DE | 102006019308 | 10/2007 |
| EP | 0 735 267 | 10/1996 |

(Continued)

OTHER PUBLICATIONS

International Search Report issued by the European Patent Office in International Application No. PCT/EP2011/004035 on Sep. 27, 2011.

(Continued)

*Primary Examiner* — John Kwon
(74) *Attorney, Agent, or Firm* — Henry M. Feiereisen LLC

(57) ABSTRACT

An internal combustion engine for a motor vehicle includes at least one cylinder, an injection valve associated to the cylinder for direct injection of fuel into a combustion chamber of the cylinder. The injection valve is received in a receiving opening of a cylinder head of the internal combustion engine and held by a support element in the receiving opening. The support element is secured in its rotational position by a formfitting engagement of a first formfit element on the injection valve, and by a formfitting engagement of a second formfit element on the cylinder head. A support element of this type ensures a particularly satisfactory securement of the rotational position of the injection valve. In the event of structural changes to the cylinder head or at the injection valve, it is only necessary to adapt the support element so that such modifications can be realized particularly inexpensively.

4 Claims, 5 Drawing Sheets

(56) References Cited

U.S. PATENT DOCUMENTS

| | | | | |
|---|---|---|---|---|
| 6,283,772 | B1 * | 9/2001 | Braun et al. | 439/100 |
| 6,431,151 | B1 * | 8/2002 | Gmelin | 123/470 |
| 7,143,955 | B2 * | 12/2006 | Geiger et al. | 239/96 |
| 7,891,343 | B2 * | 2/2011 | Braun et al. | 123/469 |
| 7,909,021 | B2 * | 3/2011 | Fujii | 123/470 |
| 8,640,674 | B2 * | 2/2014 | Sugiyama | 123/470 |
| 2002/0148446 | A1 | 10/2002 | Gmelin | |
| 2002/0162538 | A1 * | 11/2002 | Krause et al. | 123/470 |
| 2004/0020469 | A1 * | 2/2004 | Reiter et al. | 123/470 |
| 2004/0237939 | A1 * | 12/2004 | Kondo et al. | 123/470 |
| 2004/0244776 | A1 * | 12/2004 | Aota | 123/470 |
| 2007/0175450 | A1 | 8/2007 | Eckbauer et al. | |
| 2007/0246016 | A1 * | 10/2007 | Scheffel et al. | 123/470 |
| 2009/0056674 | A1 * | 3/2009 | Furst et al. | 123/470 |
| 2009/0133676 | A1 * | 5/2009 | Lepsch et al. | 123/549 |
| 2010/0154746 | A1 * | 6/2010 | Fischer et al. | 123/456 |

FOREIGN PATENT DOCUMENTS

| | | |
|---|---|---|
| FR | 2 756 872 | 6/1998 |
| JP | 2004-116499 | 4/2004 |
| WO | WO 02/075147 | 9/2002 |
| WO | WO 03/018998 | 3/2003 |

OTHER PUBLICATIONS

Chinese Search Report with respect to counterpart Chinese patent application 201180039845.6.

Translation of Chinese Search Report with respect to counterpart Chinese patent application 201180039845.6.

Chinese Search Report issued by the Chinese Patent Office on Sep. 18, 2015, in Chinese Application No. 2011800398456.

Translation of Chinese Search Report issued by the Chinese Patent Office on Sep. 18, 2015, in Chinese Application No. 2011800398456.

* cited by examiner

INTERNAL COMBUSTION ENGINE WITH INJECTION VALVE

CROSS-REFERENCES TO RELATED APPLICATIONS

This application is the U.S. National Stage of International Application No. PCT/EP2011/004035, filed Aug. 11, 2011, which designated the United States and has been published as International Publication No. WO 2012/022447 and which claims the priority of German Patent Application, Serial No. 10 2010 034 411.7, filed Aug. 14, 2010, pursuant to 35 U.S.C. 119(a)-(d).

BACKGROUND OF THE INVENTION

The invention relates to an internal combustion engine with an injection valve for direct injection of fuel into a combustion chamber of a cylinder of the internal combustion engine.

Direct injection of fuel into the combustion chambers of internal combustion engines finds increasingly application in the automotive industry. Compared to injection in a suction pipe or in an antechamber of the combustion chamber, the direct injection is able to realize an improved mixture formation so that the combustion in the combustion chamber is optimized. Furthermore, the direct injection also enables realization of layer charges, i.e. to form in the combustion chamber mixtures which have a different air-fuel ratio in different zones of the combustion chamber. In this way, it is possible to operate the internal combustion engine with an excess of oxygen at its optimum thermodynamic operating point so that the efficiency increases in particular in the partial load range. As a result, consumption and emissions of the internal combustion engine can be reduced.

The direct injection usually involves the use of injection valves which are received in receiving bores of a cylinder head of the internal combustion engine. Such injection valves must be exactly aligned since the position of the valve determines the direction of injection into the combustion chamber and thus is essential for the geometry of the mixture formation in the combustion chamber.

DE 100 12 759 A1 discloses an internal combustion engine with injection valves which are held by a spring element in the pertaining receiving bores and supported by a seat ring. The spring element provides hereby an axial securement of the injection valves.

The interaction of the spring element with a fuel rail restrains the injection valves from rotating.

DE 10 2006 019 308 A1 also describes an injection valve for an internal combustion engine. The injection valve is held by a biased sealing contour on a sealing seat of a receiving bore of the cylinder head.

Known injection valves thus involve a torsion prevention using spring tension or stop surfaces on the injection valve and on other components of the injection system. Such torsion preventions are, however, unable to keep the valve in a desired position in all operating situations and in addition are complicated to modify when the geometry of the injection valves or the cylinder head itself is changed.

SUMMARY OF THE INVENTION

It is therefore an object of the present invention to provide an internal combustion engine according to the preamble of patent claim 1 with a torsion prevention which is simple, reliable and easy to adapt to structural changes and applicable for the injection valves of the internal combustion engine.

This object is attained by an internal combustion engine including a support element, which holds an injection valve in an associated receiving opening of a cylinder head of the internal combustion engine, and which is secured in its rotational position through formfitting engagement of a first formfit element on the injection valve and through formfitting engagement of a second formfit element on the cylinder head. As a result, the rotational position of the injection valve is indirectly secured in relation to the cylinder head. The injection valve can therefore be reliably retained in its desired position so that the desired injection properties are maintained.

At the same time, such indirect securement of the rotational position can easily be suited to changes in the geometry of the cylinder head or the injection valve. Changes in the geometry of one of the two mentioned components require only adjustment of the support element to ensure a reliable securement of the rotational position of the modified component. This allows at any time an especially cost-effective adaptation of the type of injection valve and cylinder head. Even the use of another type of injection valves on the same internal combustion engine can be easily realized by conforming the support element, without requiring any structural changes on the injection valve or on the cylinder head. This enables, for example, provision of different design variants of the internal combustion engine, without requiring significant investment costs. Even different installation positions of the same injection valve on the internal combustion engine at different demands on the mixture formation can be easily realized by respectively conformed support elements.

In a preferred embodiment of the invention, the support element surrounds a shaft portion of the injection valve, at least in part about the outer circumference. Such a support element can be fitted onto the injection valve before assembly of the injection valve so that the two parts can be kept in stock as a single componentry and installed together.

Preferably, the first formfit element is configured as a receiving opening of the support element in which a connecting plug of the injection valve engages. Thus, the injection valve does not require any particular structures to complement the first formfit element. Rather an existing geometric element of the injection valve is used to ensure the securement of the rotational position between formfit element and injection valve. This reduces costs for the production of the injection valves and can optionally save weight.

In a further preferred embodiment of the invention, the second formfit element of the support element is configured as a detent nose which engages in a mating contour of the cylinder head. Such a formfit element is especially simple to manufacture and does not require complicated machining of the cylinder head so as to form the mating contour. Such a mating contour can be produced while casting the cylinder head. Preferably, the mating contour is, however, realized by machining in the form of a positioning bore in the cylinder head. Any necessary minor geometrical changes in the mating contour can therefore be realized without modifying a casting tool for the production of the cylinder head so that such changes can be carried out particularly cost-efficiently.

Preferably, the support element is maintained under tension on the injection valve. This ensures a secure seat of the support element on the injection valve so that the two components can be handled safely as a joint assembly, without the risk of inadvertent detachment of the support element from the injection valve.

In a further preferred embodiment of the invention, the support element exerts a spring force between support element and cylinder head. Thus, in the installed state of the support element, a tension is realized between the injection valve and the cylinder head, thereby providing a particularly good positional restraint of the injection valve.

The invention further relates to a motor vehicle having an internal combustion engine of the described type.

BRIEF DESCRIPTION OF THE DRAWING

The invention and its embodiments will now be explained in greater detail with reference to the drawing. It is shown in:

FIG. 1 shows a perspective view of a portion of a cylinder head 10 for an internal combustion engine. The cylinder head 10 has a receiving bore 2 for an injection valve 14.

DETAILED DESCRIPTION OF PREFERRED EMBODIMENTS

Figure 1:
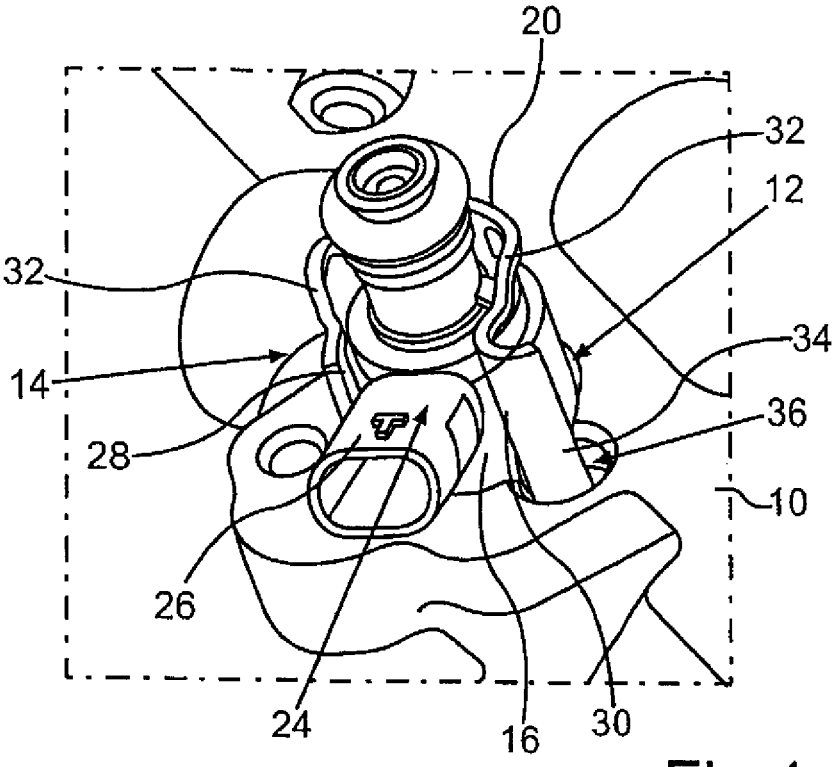
FIG. 1 a perspective view of a cylinder head of an exemplary embodiment of an internal combustion engine according to the invention with installed injection valve.
Figure 2:
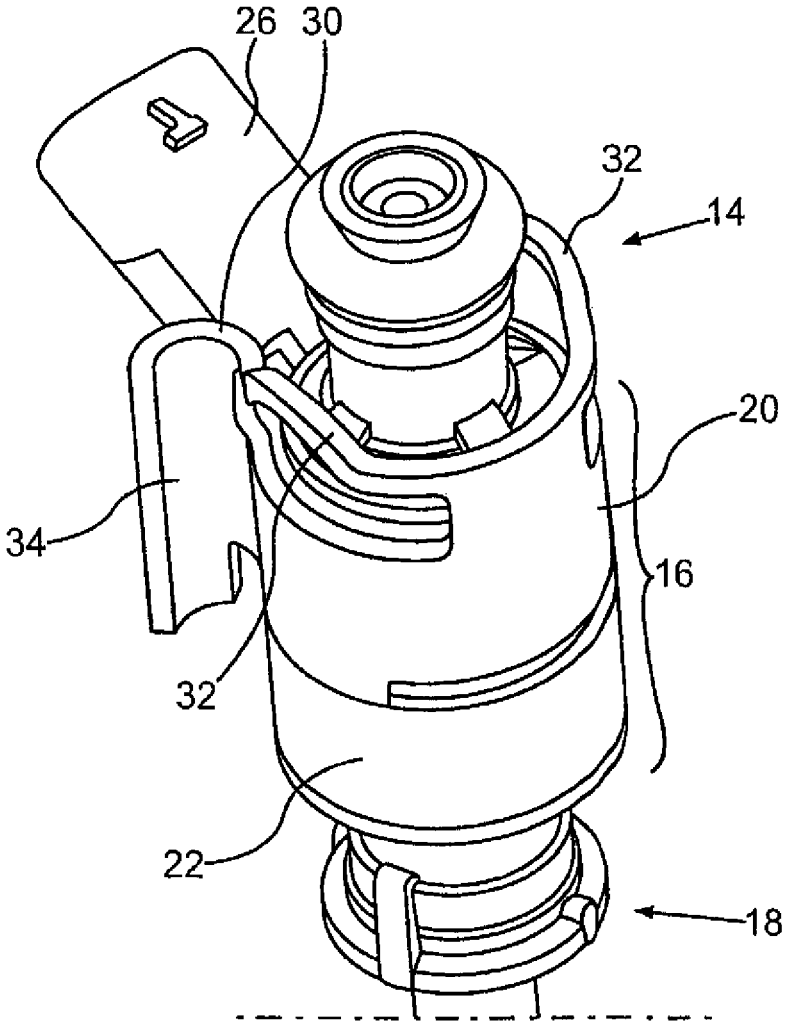
FIG. 2 a perspective view of an injection valve with support element for use in an exemplary embodiment of an internal combustion engine according to the invention.

The injection valve 14 shown separately in FIG. 2 by way of a perspective view has a shaft portion 16 for insertion in the receiving bore 12 so as to protrude with its nozzle end 18 into a combustion chamber of the internal combustion engine. Fuel can be injected through the injection valve 14 under high pressure into the combustion chamber to enable an improved mixture formation in the combustion chamber. In addition, the direct injection of fuel is able to produce different mixture ratios in different zones of the combustion chamber, thereby rendering it possible to operate the internal combustion engine at its optimum thermodynamic operating point and to thereby optimize its efficiency.

Figure 3:
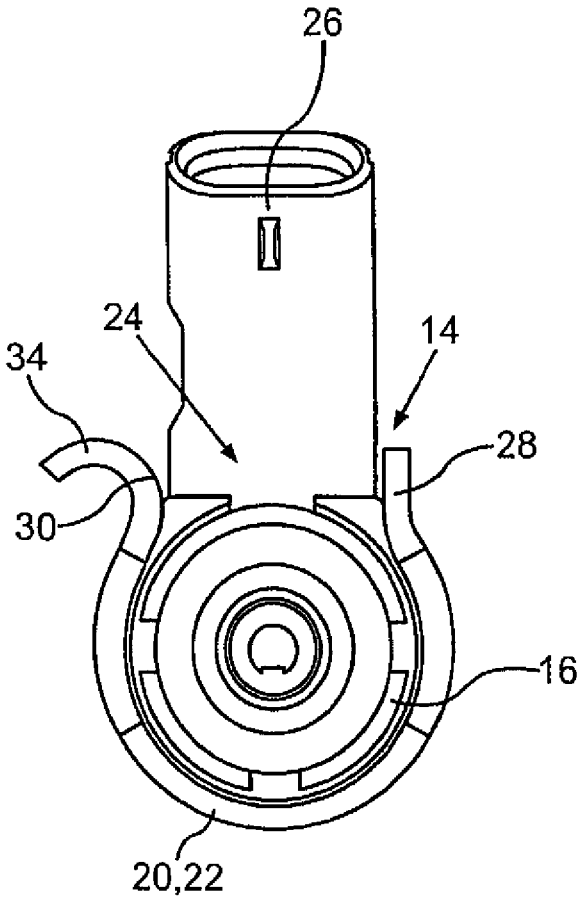
FIG. 3 a top view of the injection valve with support element according to FIG. 2.
Figure 4:
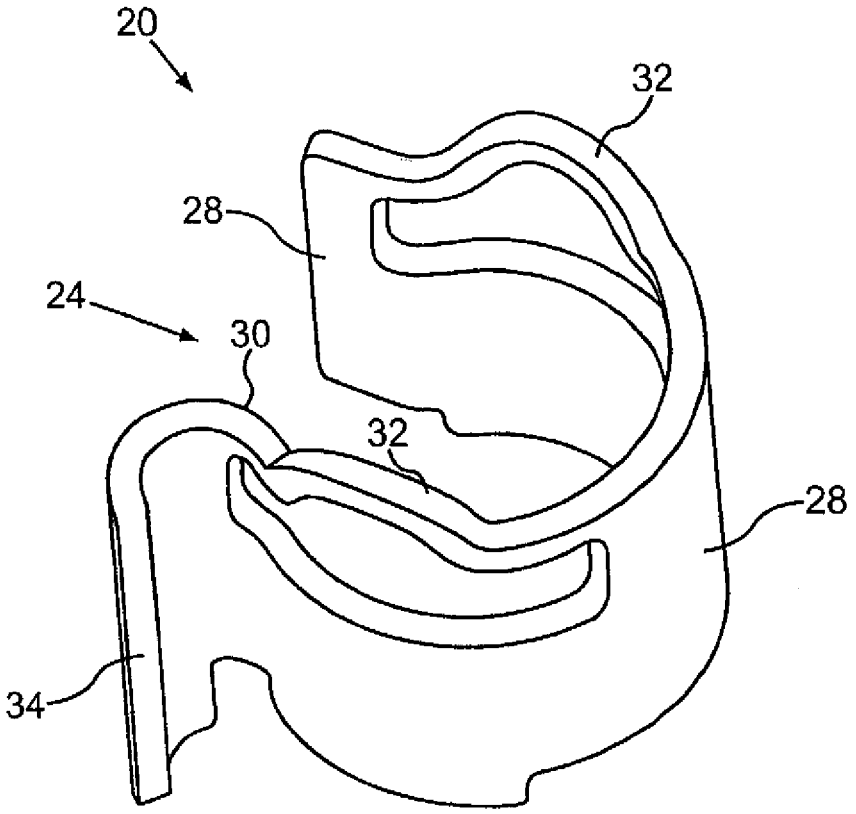
FIG. 4 a perspective view of a support element for an injection valve for use in an exemplary embodiment of an internal combustion engine according to the invention.
Figure 5:
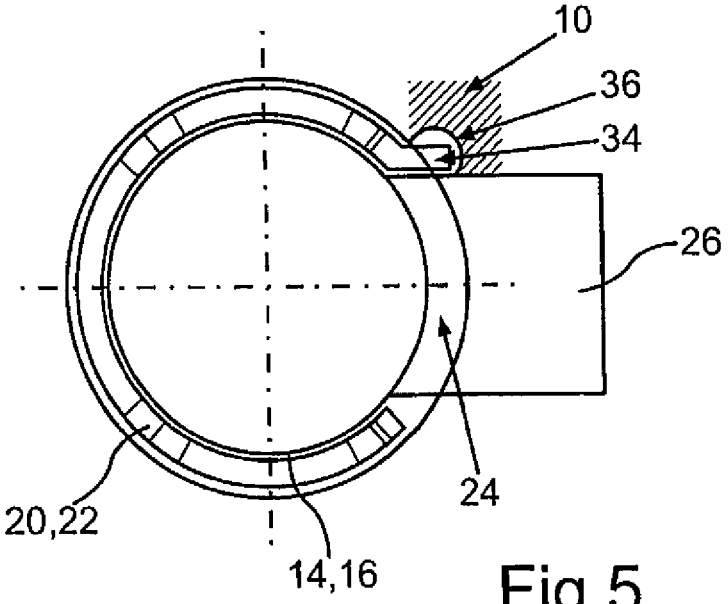
FIG. 5 a sectional view through a cylinder head of an exemplary embodiment of an internal combustion engine according to the invention in the region of an injection valve.

To allow such a locally controlled mixture formation, it is necessary to precisely position the injection valve 14 in the receiving bore 12. Especially important is hereby to restrain the injection valve 14 against rotation in relation to the cylinder head 10. For this purpose, a support element 20 is provided. The support element 20 surrounds the shaft portion 16 of the injection valve 14 partly circumferentially. For this purpose, the support element 20, as is especially clearly shown in FIGS. 3 and 4, has a sleeve-shaped or clip-shaped base body 22 which can be clamped resiliently with the shaft portion 16 of the injection valve 14.

The base body 22 has a receiving opening 24 which laterally surrounds a connecting plug 26 of the injection valve 4 in the installation position of the support element 20. The connecting plug 26 rests against stop faces 28, 30 of the support element 20 so that the rotational position of the support element 20 is secured in relation to the injection valve 14. The sleeve-shaped base body 22 also has gripping elements 32 which allow easy assembly and disassembly of the support element 20.

A detent nose 34 projecting laterally from the base body 22 protrudes into a positioning bore 36 of the cylinder head 10 in the installation position of the support element 20. In this way, the injection valve 14, provided with the support element 20, is prevented from rotating in relation to the cylinder head 10.

A desired change in the relative position between cylinder head 10 and injection valve 14 can be realized through simple adaptation of the geometry of the support element 20, without requiring a modification of expensive casting tools for the cylinder head 10 or for the injection valve 14. Even in the presence of geometric changes to the cylinder head 10 or at the injection valve 14, the correct positioning of the injection valve 14 can be realized by simply modifying the support element 20. In this way, the rotational position of the injection valve 14 can be secured in a particularly simple manner to suit changing structural situations or changed injection conditions.

What is claimed is:

1. An internal combustion engine for a motor vehicle, comprising:

a cylinder head having at least one cylinder;

an injection valve received in a receiving opening of a cylinder head for direct injection of fuel into a combustion chamber of the cylinder and having a shaft portion and a connecting plug; and a support element holding the injection valve in the receiving opening and configured to secure a rotational position of the support element, said supporting element having a first portion formed as a base body formfittingly surrounding at least a part of an outer circumference of the shaft portion of the injection valve and having two ends spaced from one another in a circumferential direction, two further portions extending from the ends of the first portion of the support element and forming stop faces which define there between a receiving opening in which the connecting plug of the injection valve is received, and an additional portion extending from one of the further portions and forming a detent nose formfittingly axially engaging in a bore of the cylinder head, wherein the support element has two gripping portions for assembly and disassembly of the support element, the gripping portions being spaced from one another in the circumferential direction and each formed by a peripherally closed elongated opening which is free of other components, wherein the elongated opening of one of the gripping portions ends in a direction of elongation before the detent nose, and the detent nose is located in the direction of elongation outwardly beyond the one gripping portion.

2. The internal combustion engine of claim 1, wherein the support element is constructed to be held under tension on the injection valve and to apply a spring force between the support element and the cylinder head.

3. A motor vehicle, comprising an internal combustion engine including a cylinder head having at least one cylinder, an injection valve received in a receiving opening of a cylinder head for direct injection of fuel into a combustion chamber of the cylinder and having a shaft portion and a connecting plug, and a support element holding the injection valve in the receiving opening and configured to secure a rotational position of the support element, said support element having a first portion formed as a base body formfittingly surrounding at least a part of an outer circumference of the shaft portion of the injection valve and having two ends spaced from one another in a circumferential direction, two further portions extending from the ends of the first portion of the support element and forming stop faces which define there between a receiving opening in which the connecting plug of the injection valve is received, and an additional portion extending from one of the further portions and forming a detent nose formfittingly axially engaging in a bore of the cylinder head, wherein the support element has two gripping portions for assembly and disassembly of the support element, the gripping portions being spaced from one another in the circumferential direction and each formed by a peripherally closed elongated opening which is free of other components, wherein the elongated opening of one of the gripping portions ends in a direction of elongation before the detent nose, and the detent nose is located in the direction of elongation outwardly beyond the one gripping portion.

4. The motor vehicle of claim 3, wherein the supporting element is constructed to be held under tension on the injection valve and to apply a spring force between the support element and the cylinder head.

* * * * *